United States Patent [19]

Sekiguchi

[11] 4,280,113

[45] Jul. 21, 1981

[54] FILTER FOR MICROWAVES

[75] Inventor: Mitsuo Sekiguchi, Soma, Japan

[73] Assignee: Alps Electric Co., Ltd., Tokyo, Japan

[21] Appl. No.: 107,526

[22] Filed: Dec. 27, 1979

[30] Foreign Application Priority Data

Dec. 28, 1978 [JP] Japan ..... 53/179706[U]

[51] Int. Cl.[3] ..... H01P 1/208; H01P 7/06; H01P 1/20

[52] U.S. Cl. ..... 333/202; 333/212; 333/230

[58] Field of Search ..... 333/202, 203, 204, 205, 333/206-212, 245, 248, 219-227, 230, 235; 334/1, 41-44, 83-84, 85, 89

[56] References Cited

U.S. PATENT DOCUMENTS 3,538,466 11/1970 Brand ..... 334/43

*Primary Examiner*—Marvin L. Nussbaum

*Attorney, Agent, or Firm*—Guy W. Shoup; Gerard F. Dunne

[57] ABSTRACT

In a microwave filter including a plurality of resonator cavities, at least one of the windows between cavities for coupling them is formed near the end portions of the resonance rods in the cavities, and a part of one of the coupling loops for transmitting signals of microwave frequencies is coplanar with the opening thereby to form an attentuation pole capable of abrupt attenuation of any image frequency.

7 Claims, 9 Drawing Figures

FILTER FOR MICROWAVES

The present invention relates to a filter for microwaves.

Conventional microwave filters have usually been constructed from a housing and separate resonance rods fastened to the housing by screws or the like. Accordingly, when the microwave filter is subjected to mechanical vibrations or impacts, the contact of the resonance rod with the housing becomes very unstable, especially at the root or base part of the resonance rods. This leads to the disadvantage that in case of resonance at a frequency of, for example, 2 to 3 GHz in the UHF range, transmission losses increase, while the resonance frequency fluctuates.

The inventor of the present application has proposed a microwave filter in which the resonance rods and a housing are unitarily formed (refer to Ser. No. 61,415 filed July 27, 1979 and entitled "FILTER FOR MICROWAVES"). The present invention consists in an improvement on the prior invention.

An object of the present invention is to provide a filter for microwaves in which the resonance rods and the housing are unitarily formed.

Another object of the present invention is to provide a filter for microwaves in which adjustments in the electrical characteristics can be readily made.

Still another object of the present invention is to provide a filter for microwaves which can mitigate the so-called image rejection.

The present invention resides in a microwave filter wherein resonator cavities are coupled in a multistage fashion, characterized in that at least one of the coupling loop for input and the coupling loop for output is located adjacent a coupling window portion at the upper portion of the associated resonator cavity.

Figure 1:
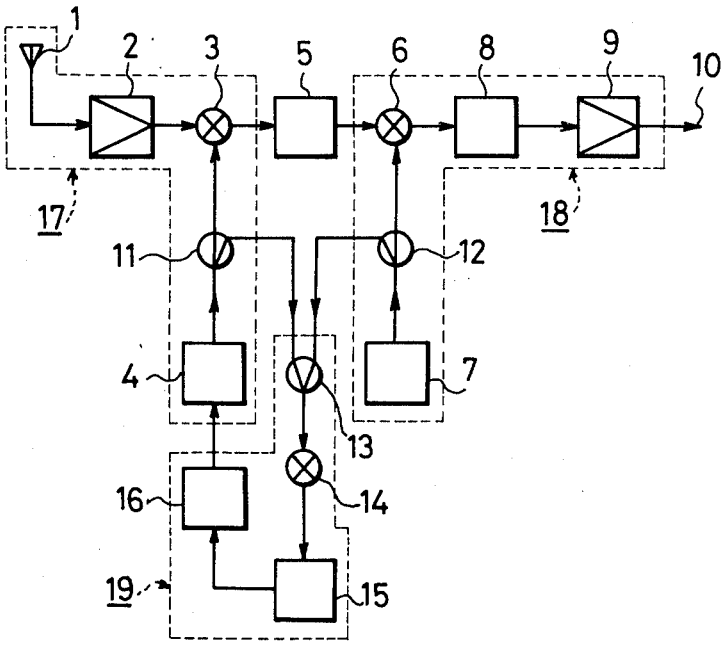
FIG. 1 is a block diagram of a television tuner of the double superheterodyne type which employs a filter for microwaves according to the present invention.
Figure 2:
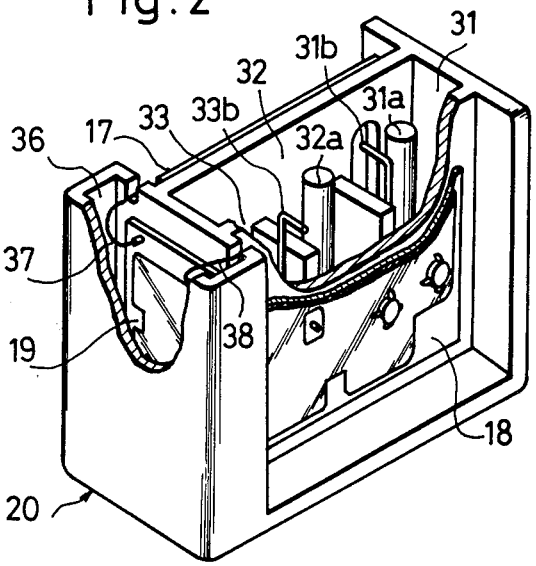
FIG. 2 is a perspective view, partly broken away, of an embodiment of the microwave filter of the present invention.

FIG. 1 is a circuit diagram of a double superheterodyne tuner having a microwave filter. The tuner includes an antenna 1, an amplifier 2, a first mixer 3, a variable oscillator 4, a first intermediate frequence filter 5 comprised of a filter for microwaves, a second mixer 6, a fixed oscillator 7, a second intermediate frequency filter 8, a secon intermediate frequency amplifier 9, an output terminal 10, a frequency distributor 11, a frequency distributor 12, a frequency synthesizer 1, a phase locked loop (PPL) mixer 14, a low-pass filter 15, a PLL block 16, an IC board 17, an IC board 18, and an IC board 19.

The IC board 17 includes the circuits necessary to add the input signal from the antenna 1 to the amplifier 2, to mix in the first mixer 3 the output of the amplifer with a portion of the output of the variable oscillator 4 distributed by the distributor 11, and to direct the resulting mixed output of the mixer 3 to the first intermediate frequency filter 5.

The IC board 18 includes the circuits necessary to mix, by way of the second mixer 6, the first intermediate frequency signals leaving the first intermediate frequency filter 5 together with a portion of the output of the fixed oscillator 7 distributed by the distributor 12, to direct the mixed output to the second intermediate frequency filter 8, and to amplify by means of the amplifier 9 the second intermediate frequency signals produced by the second intermediate frequency filter 8 thereby to produce the amplified output at the terminal 10.

The IC board 19 includes the circuits necessary to synthesize, by means of the synthesizer 13, a portion of the output of the variable oscillator 4 distributed by the distributor 11 in the IC board 17 and a portion of the output of the fixed oscillator 7 distributed by the distributor 12 in the IC board 18. Further, the IC board 19 has circuitry to convert the output of the synthesizer 13 through the PLL mixer 14, and to select, from the converted output and by means of the low-pass filter 15, only low frequencies corresponding to the limiting frequency of a frequency divider incorporated in the PLL block 16, as will be described more fully below. The IC board 19 also includes circuitry to pass the output of the low-pass filter 15 to the PLL block 16 to thereby control the variable oscillator 4 in the IC board 17.

The PLL block 16 is typical of known PLL arrangements and includes a variable frequency divider, a program switch, a phase detector, a reference signal generator and a low-pass filter. The PLL circuit is established by a closed circuit including the PLL block 16 and the abovementioned variable oscillator 4, PLL mixer 14, and low-pass filter 15.

In receiving a desired channel, if the difference between a frequency of the variable oscillator 4 and a frequency of the fixed oscillator is maintained at a constant value, the output of the terminal 10 is always maintained constant.

A double superheterodyne tuner can therefore be obtained by connecting the abovementioned IC boards 17, 18 and 19 with the first intermediate frequency filter 5, which serves as a microwave filter, as illustrated.

An embodiment of the microwave filter of the present invention is illustrated in FIGS. 2 to 6. As shown in a partially broken perspective view of FIG. 2, a housing 20 includes a plurality of resonator cavities 31, 32 and 33. The resonator cavities 31 to 33 have respective resonance rods 31*a* to 33*a* which are formed unitarily with the housing.

The housing and the unitary resonance rods are preferably formed by die casting of an aluminum alloy. Suitable examples of the alloy are described in detail in the application referred to previously.

Further, a coupling window 34*a* is formed in the wall 34 between the resonant cavity 31 and the resonant cavity 32, while a coupling window 35*a* is formed in the wall 35 between the resonant cavity 32 and the resonant cavity 33.

Figure 3:
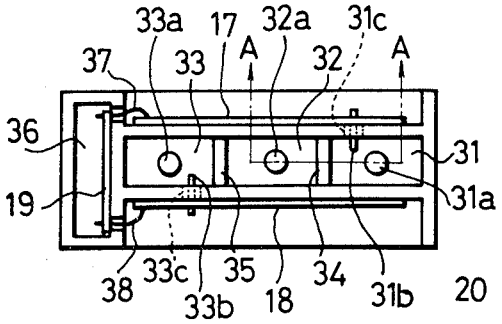
FIG. 3 is a top plan view of the microwave filter shown in FIG. 2.
Figure 4:
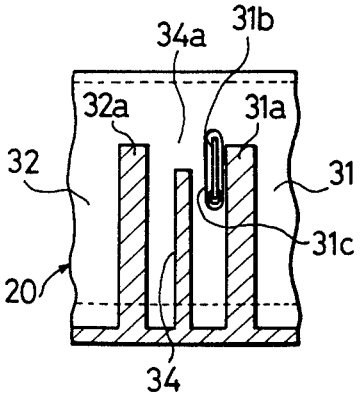
FIG. 4 is a sectional view taken along line A—A in FIG. 3.
Figure 5:
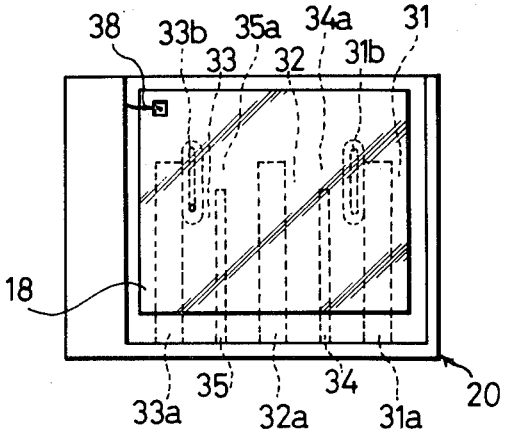
FIG. 5 is a side view of the microwave filter shown in FIG. 2.
Figure 6:
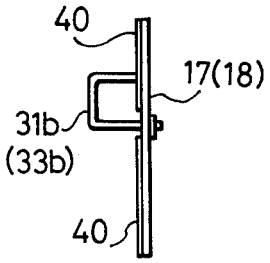
FIG. 6 is a side view showing the mounted state of a coupling loop and an IC board in the microwave filter of the present invention.

A coupling loop 31*b* is arranged in the resonator cavity 31, while a coupling loop 33*b* is arranged in the resonator cavity 33. The coupling loops 31*b* and 33*b* are respectively fixed to the hybrid IC boards 17 and 18 in the manner shown in FIG. 6, and extend through respective holes 31*c* and 33*c* formed in the housing 20 so as to be coplanar with the respective wall 34 or 35. The inner surface of each IC board 17 or 18 is entirely formed by a conductive surface 40, and one end of the respective coupling loop is connected with this surface. Accordingly, when the IC boards 17 and 18 are secured to the side surfaces of the housing 20 as illustrated in FIG. 3, the aforecited ends of the coupling loops 31*b* and 33*b* are grounded to the housing 20 through the conductive surfaces 40, and the holes 31*c* and 33*c* are covered up by the conductive surfaces 40. Shown at 36 is a portion which receives the IC board 19 therein. The IC board 19 is electrically connected with the IC boards 17 and 18 by means of leads 37 and 38, respectively.

To be noted in this embodiment is that the coupling loop 31*b* for input to the filter and the coupling loop 33*b* for output form the filter are located near the top end portions of the adjacent resonance rod 31*a* or 33*a*, and are coplanar with the respective coupling window 34*a* or 35*a*. More specifically, by causing parts of the coupling loops to face the coupling windows, the electromagnetic coupling between adjacent resonator cavities is by both inductive coupling and capacitive coupling. A signal having gone through by inductive coupling and a signal having gone through by capacitive coupling are thereby made opposite to each other, and an attenuation pole is thus caused to appear at a frequency at which the amplitudes of both the signals become equal.

In general, in filters for microwaves, the so-called image rejection becomes a problem. The image rejection is an operation in which an image frequency is rejected. The image frequency $f_I$ is given by the following equation:

$$f_I = f_L - f_{IF} = f_o - 2 \times f_{IF}$$
$$(f_L = f_o - f_{IF})$$

where $f_L$—local oscillation frequency, $f_o$—receiving frequency, $f_{IF}$—intermediate frequency.

In the prior art microwave filter constructed of coupling paths of only either inductive coupling or capacitive coupling, the image frequency (90 MHz in U.S.) can be rejected up to a degree of attenuation of 55–60 dB. In the case of the present invention, it has been experimentally confirmed that a degree of attenuation of 75 dB is attained by forming the attenuation pole for the image frequency.

Since the coupling loops 31*b* and 33*b* are located at upper parts of the housing 20, the degree of coupling can be adjusted very easily. An upper opening is covered with a lid (not shown) after the adjustment. Since the conductive surfaces 40 disposed on the inner surfaces of the IC boards 17 and 18 abut on the holes 31*c* and 33*c* in the housing 20 in a manner to close them, any transmission loss of the signals ascribable to the formation of the holes 31*c* and 33*c* does not occur.

Figure 7:
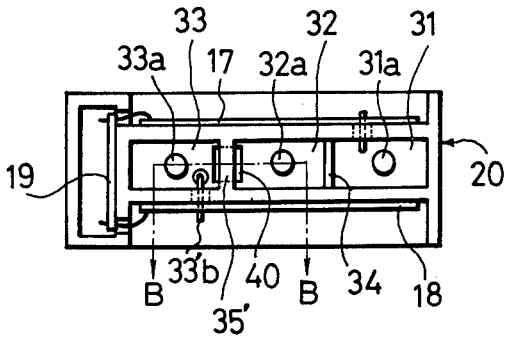
FIG. 7 is a top plan view of another embodiment of the microwave filter of the present invention.
Figure 8:
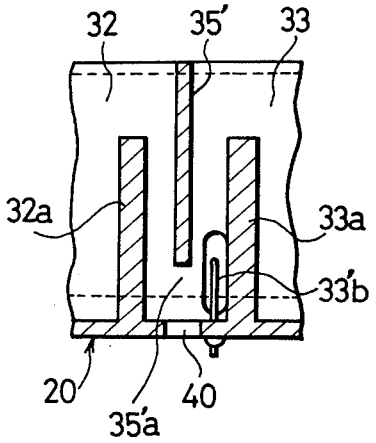
FIG. 8 is a sectional view taken along line B—B in FIG. 7.
Figure 9:
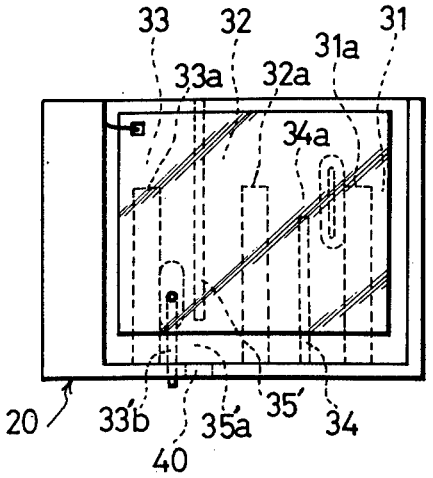
FIG. 9 is a side view of the microwave filter shown in FIG. 7.

FIGS. 7 to 9 illustrate another embodiment of the present invention. Although a resonator 31 on the right side as viewed in the drawing is the same as in the foregoing embodiment, a coupling window 35*a*′ in the wall 35′ between resonator 32 and a resonator 33 is formed near the base of resonance rods 32*a* and 33*a*, and top end portions of the resonance rods 32*a* and 33*a* are shielded by the wall 35′. A coupling loop 33*b*′ is arranged rear the base of the resonance rod 33*a*. A hole 40 is formed in a lower part of the housing 21 in a manner to communicate between the resonators 32 and 33. Also with the microwave filter of such structure, coupling paths based on the inductive coupling and the capacitive coupling appear, and an attenuation pole capable of causing an abrupt attenuation can be obtained.

What is claimed is:

1. In a filter for signals in the microwave frequencies, comprising a plurality of resonator cavities separated by respective walls therebetween, each said cavity being formed of a housing and a respective resonance rod formed unitarily with said housing, means including windows formed in said walls for coupling said cavities together and coupling loops for transmitting said signals;

the improvement comprising the fact that at least one of said windows is formed in proximity to top end portions of the resonance rods and that a portion of one of said coupling loops is substantially coplanar with said window.

2. A filter for microwaves according to claim 1, wherein said housing is formed with holes for locating said coupling loops in the resonance cavities.

3. A filter for microwaves according to claim 2, wherein IC boards to which said respective coupling loops are fixed are secured to side surfaces of said housing in such a manner that said respective coupling loops project into the corresponding holes.

4. A filter for microwaves according to claim 3, wherein those portions of said IC boards to which said coupling loops are fixed are formed with conductive portions, and said conductive portions cover up said holes in said housing when said IC boards are fixed to said housing.

5. A filter for microwaves according to claim 4, wherein one end of each said coupling loop is electrically connected to the corresponding conductive portion and is grounded to said housing through said conductive portion.

6. A filter for microwaves according to claim 1, wherein an upper portion of said housing has an opening therein to permit adjustments of said coupling loops.

7. A filter for microwaves according to claim 6, wherein said opening in said housing is covered with a lid member.

* * * * *